US008223119B1

(12) United States Patent
Krenz et al.

(10) Patent No.: US 8,223,119 B1
(45) Date of Patent: Jul. 17, 2012

(54) SYSTEM AND APPARATUS FOR GRAPHICAL FLIGHT DISPLAY MANIPULATION

(75) Inventors: Michael J. Krenz, Cedar Rapids, IA (US); Pamela K. Hahn, Cedar Rapids, IA (US); Bryan C. Schultz, Marion, IA (US); Charles B. Dirks, Swisher, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 994 days.

(21) Appl. No.: 11/824,265

(22) Filed: Jun. 29, 2007

(51) Int. Cl.
*G09G 5/00* (2006.01)

(52) U.S. Cl. ..... 345/156; 340/971; 340/976; 701/418; 701/428; 701/487; 701/488

(58) Field of Classification Search ..... 345/156; 340/971, 976; 701/418, 428, 487, 488
See application file for complete search history.

(56) References Cited

U.S. PATENT DOCUMENTS

| | | | | |
|---|---|---|---|---|
| 5,786,849 | A * | 7/1998 | Lynde | 348/113 |
| 6,112,141 | A * | 8/2000 | Briffe et al. | 701/14 |
| 6,633,810 | B1 * | 10/2003 | Qureshi et al. | 701/206 |
| 6,784,869 | B1 * | 8/2004 | Clark et al. | 345/156 |
| 7,508,322 | B1 * | 3/2009 | Krenz et al. | 340/976 |

* cited by examiner

*Primary Examiner* — Kevin M Nguyen
*Assistant Examiner* — Kenneth B Lee, Jr.
(74) *Attorney, Agent, or Firm* — Donna P. Suchy; Daniel M. Barbieri

(57) ABSTRACT

A system for providing a manipulatable graphical display comprising a user input device responsive to a user input, a cursor control device operably coupled to the user input device, and a menu engine operably coupled to the cursor control device. The cursor control device is further configured to process an output received from the user input device and generate a cursor image positioned on a display in response to the user output suitable for locking onto and tracing a path on the display.

14 Claims, 3 Drawing Sheets

SYSTEM AND APPARATUS FOR GRAPHICAL FLIGHT DISPLAY MANIPULATION

FIELD OF THE INVENTION

The present invention relates, generally, to aircraft cockpit displays and, more particularly, to a system and method for manipulating a graphical flight display.

BACKGROUND OF THE INVENTION

Aircraft flight displays continue to advance in sophistication, achieving increasingly higher levels of information density, and consequently, presenting an increase in visual information to be perceived and understood by the operator. In many applications, it is important that visual displays provide a proper cognitive mapping between what the operator is trying to achieve and the information available to accomplish the task. As a result, such systems increasingly utilize human factor design principles in order to build instrumentation and controls that work cooperatively with human operators.

Although cockpit user interfaces have improved in recent years, additional improvements in user friendliness and ease of use of graphical flight displays are desired. For example, flight planning typically involves dynamically placed objects that do not lend themselves easily to graphical manipulation without smooth cursors. Particularly problematic for in flight route manipulation is selecting discrete objects on a graphical flight display using smooth cursors, which is especially difficult in harsh environments such as flight decks. Specifically, motion within the aircraft makes it difficult to select or manipulate a flight plan if any alterations are desired or required. Typically, when an addition or alteration is made on current interfaces with onboard flight management systems, the pilot is required to know in advance the intended input structure and pattern. This requirement for the memorization of the specific input procedures associated with each type of edit limits a pilot's ability to access the full realm of current navigation systems.

Consequently, a system and method for providing accurate and efficient graphical flight planning interface manipulation is needed.

SUMMARY OF THE INVENTION

Accordingly, the various embodiments of the present invention are directed to a system and method for providing a graphical flight planning interface.

According to a first embodiment, a system for providing a graphical flight planning interface is disclosed. System comprises a user input device, a cursor control device and a menu engine. User input device is suitable for receiving flight plan information from a user. Cursor control device may be suitable for providing tracked motion for a cursor image displayed on a graphical display. Specifically, cursor control device may limit cursor movements to a displayed flight route path when a cursor image is placed on the flight route. In this manner, an operator may follow the flight path with the cursor image and acquire flight path information at any desired point along the flight path. System menu engine is suitable for generating and displaying relevant flight information at a point along the displayed flight route when the cursor image is placed on the point via the cursor control device.

According to a second embodiment, an apparatus suitable for providing a graphical flight planning interface is disclosed. Apparatus may be a display operably connected to a system suitable for providing cursor image control. Display is suitable for providing a visual interface for an operator utilizing a system according to an exemplary embodiment of the present invention. Display may further comprise a view of an aircraft symbol, one or more waypoint symbols, and a plurality of line segments connecting the waypoint symbols. Display suitably comprises a cursor image suitable for positioning in accordance with input from a user input device received via a cursor control device. Cursor image is suitable for locking onto and tracing any of the plurality of line segments. Display may also be suitable for displaying an information readout suitable for providing flight information and an interactive menu suitable for providing flight information and flight path manipulation.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to presently preferred embodiments of the invention, examples of which are illustrated in the accompanying drawings.

Figure 1:
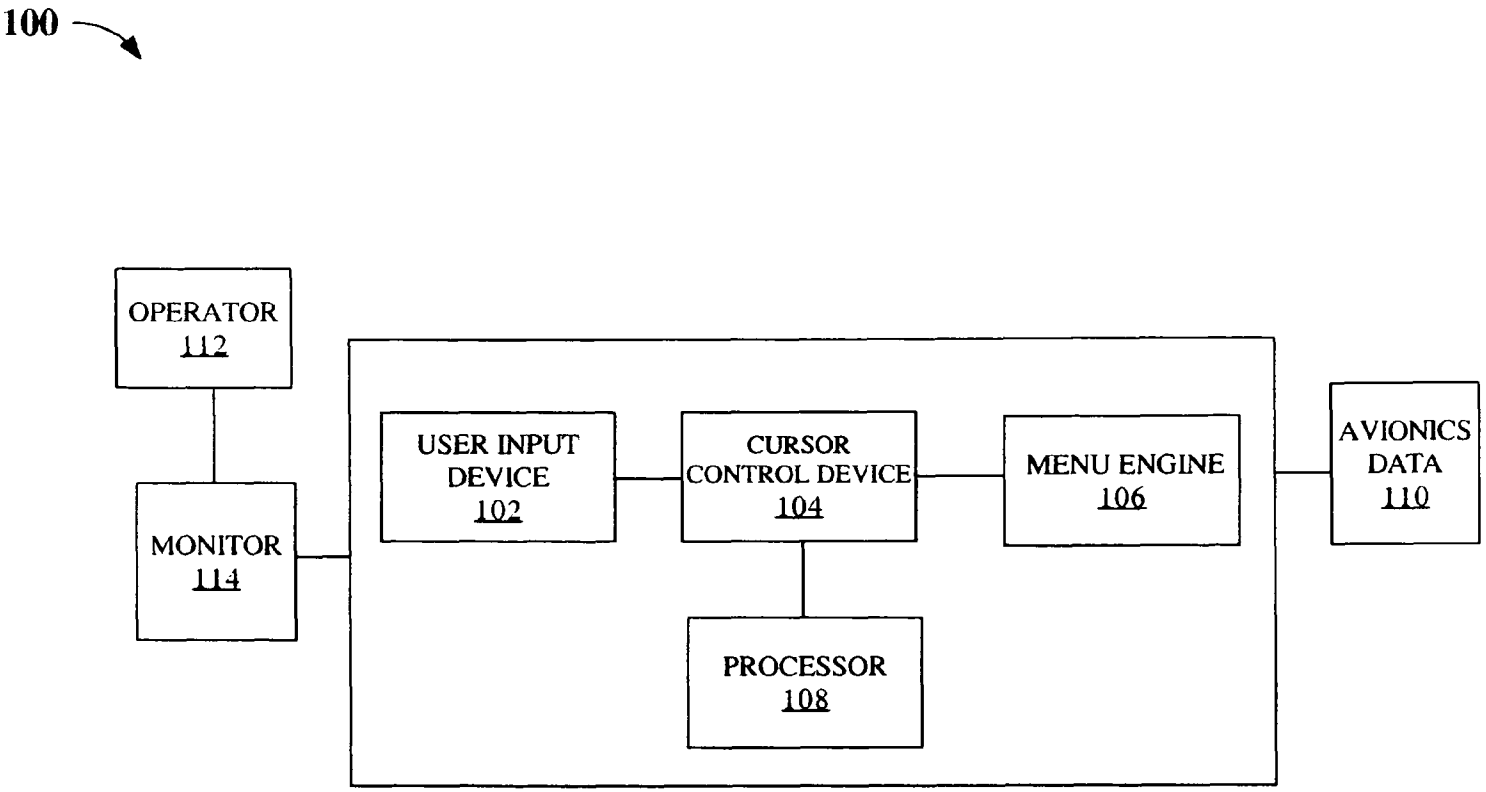
FIG. 1 is a block diagram of a system according to an exemplary embodiment of the present invention.

Referring now to FIG. 1, a cursor system 100 in accordance with various aspects of the present invention comprises a user input device 102, a cursor control device 104 and a cursor select menu 106. User input device 102 is suitable for receiving an input from an operator 112, and transmitting an output based on the received input to the cursor control device 104. System 100 is suitable for providing effective graphical flight planning interface manipulation and information display by providing tracking of a predetermined flight plan via the cursor control device 104. The cursor control device 104 is suitable for controlling a graphical cursor image on a flight planning interface. Specifically cursor control device 104 provides instructions to a cursor image for graphical flight planning when cursor image is placed, via the cursor control device 104, on desired location on the graphical display. Instructions may be based at least in part on an algorithm generated when the cursor control device receives an output from the user input device 102.

In an exemplary embodiment, cursor control device 104 is suitable for providing movement instructions to a cursor image, allowing the cursor image to move along the path a flight plan when the cursor image is placed on any point or position on a flight plan route, waypoint or like object providing visual indicia of a link between at least two points of a flight plan on the graphical display. The operator 112 may manipulate the cursor control device 104 and the cursor image may be responsive to the cursor control device manipulation. Cursor image may trace along a flight plan route segment and through pre-determined waypoints when the cursor image is positioned within a certain distance of the segment. In one embodiment, the cursor image may be configured to lock onto a point on the flight plan route. As stated earlier, a point may be any discrete location on the flight plan route, including, but not limited to, any waypoints displayed on the route. In this manner, system 100 is enabled to provide increased context sensitive operations, and is not limited to providing such context sensitive functionality only at waypoints along the route. When the cursor image is placed on, substantially on or within proximity to a flight plan segment on the graphical display, the cursor image may lock onto a nearest point along the flight plan segment. Subsequent to the locking of the cursor image to the flight plan point, cursor control device 104 may allow cursor image to trace the path of the flight plan. In one embodiment, cursor control device 104 may provide at least one dimension of movement to the cursor image associated with allowing the cursor to trace along a flight plan route. To this end, cursor control device 104 may be a single dimension device such as a knob, utilized implement cursor image tracing along the flight plan. Cursor control device 104 may provide a second dimension of cursor image movement, via a two-dimensional cursor control device suitable for providing a context sensitive operation based upon the location of the cursor image along the flight plan. By constraining the cursor image movement in this way, a user may easily and efficiently manipulate and position the cursor image accurately along the flight plan utilizing discrete devices such as knobs or buttons. When it is desired to removed the cursor image from the flight plan, cursor control device 104 provides a release function suitable for removing the cursor image from the flight plan and placing the cursor image onto another portion of the display.

According to various embodiments of the invention, the cursor control device 104 may be any user manipulatable device, such as one or more mechanical button controls, a multifunction keyboard and the like. The cursor control device 104 controls may be designed such that the pilot can easily control interactive navigation while maintaining primary attention on the displays. Cursor control device 104 may be any device suitable to accept input from user and convert that input to a graphical position on display. Various joysticks, mice, trackballs, turn knobs and the like are suitable for this purpose. In one embodiment, cursor control device 104 comprises a touch-pad interface device with a thumb actuation switch on the side. In this embodiment, the user rests his or her hand on a built-in palm-rest to stabilize the hand, position the fingertip for pointing, and position the thumb for clicking. Alternate embodiments of cursor control device 104 may include additional buttons or buttons in conjunction with a touchpad, or other tactile responsive devices.

System 100 further comprises a processor 108 configured to communicate with an associated monitor 114 (or monitors) and avionics data 110 received from one or more data sources. In general, an operator 112 may control the system 100, and may input instructions via the user input device 102 and view the output via the monitor 114. For instance, operator 112 may be a pilot or other crew member, located within an aircraft and may provide input to processor 108 through a user input device 102. Processor 108 encompasses one more functional blocks utilized to provide flight management and control, interface with cursor control device, and drive the monitor. In this regard, processor 108 may comprise any number of individual microprocessors, memories, storage devices, interface cards, and other standard components known in the art. Avionics data 110 comprises standard information related to the state of the aircraft. Data sources comprise various types of data required by the system, for example, flight plan data, data related to airways, navigational aids (Navaids), symbol textures, navigational data, obstructions, font textures, taxi registration, Special Use Airspace, political boundaries, COM frequencies (enroute and airports), approach information, and the like.

System 100 may be utilized with any aircraft routing type, including airway routing, navigational aid (navaid) routing and direct routing. Airway routing refers to routing along pre-defined pathways called airways. An airway may be a three-dimensional route for an aircraft. Navaid routing refers to routing that occurs between navaids which may not be connected by airways. Direct routing refers to routing having one or both of the route segment endpoints at a latitude/longitude which is not located at a navaid. It is further contemplated that system 100 may be implemented with a route composed of segments of different routing types, including routing types, segment types and waypoint types not specifically listed. For instance, it is contemplated that system 100 may be suitable for use with navigation reference system (NRS) waypoints as may be necessary with U.S. FAA High Altitude Redesign implementations or like technologies. System 100 is suitable for providing two dimensional path tracking of the various flight plan route types. Processor 108 may be suitable for determining the type of path based on a user input and may communicate path information to the cursor control device 104. The cursor control device 104 may then generate and control a cursor image on the display based on the information received from the processor.

The menu engine 106 may also be suitable for generating a menu based on flight plan route type information processed by the processor 108. Specifically, for each of the potential location types along the flight plan, the cursor system menu engine 106 may provide at least one context sensitive menu to aid a user in stepping through potential edits. For instance, the menu displayed at the origin airport may differ from the menu displayed at a waypoint along the route or from a menu displayed at the beginning, end, or middle of a procedural object (e.g. HOLD, Approach, Standard Instrument Departure (SID), Standard Terminal Arrival Route (STAR), and the like.) SIDs and STARs are procedures and checkpoints used to enter and leave the airway system. A SID defines a pathway out of an airport and onto the airway structure, and a STAR defines a pathway into an airport from the airway structure.

System menu engine 106 may also provide a procedures menu display. A procedure may further have a chart an associated, and any chart could have one or a plurality of associated procedures associated. The two may be combined as more of the charts become objectized and more cockpits become paperless. Therefore, "charts" and "procedures" may either be considered synonymous or separate entities.

Figure 2A:
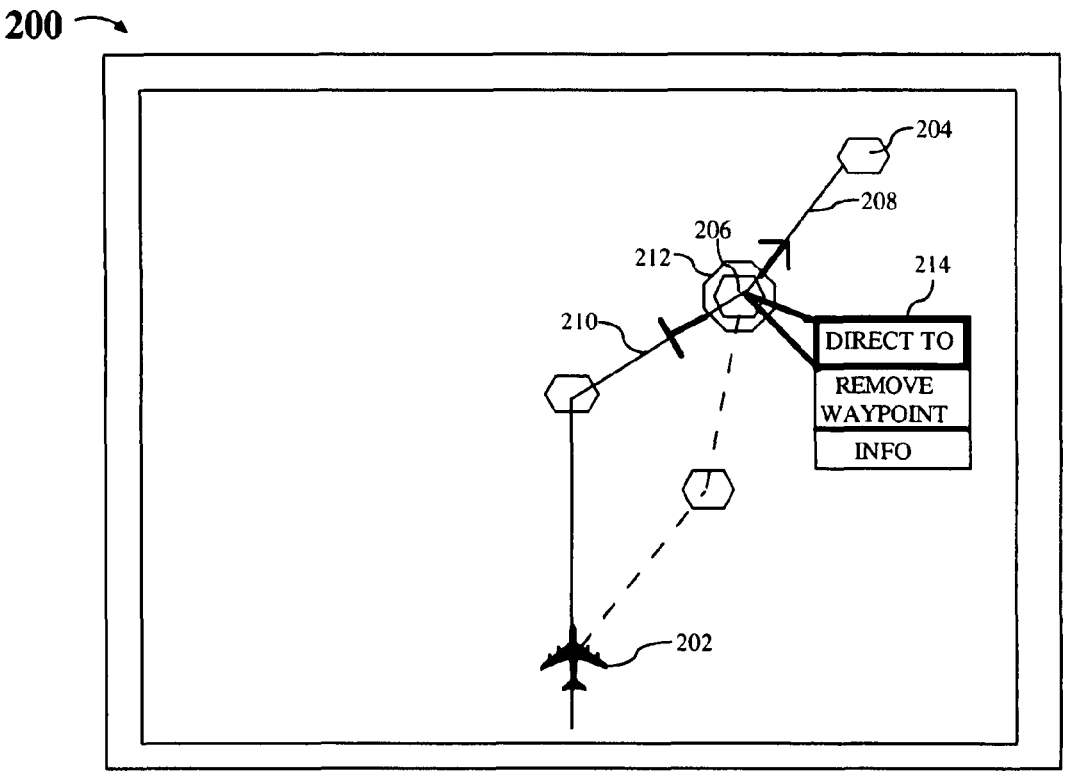
FIG. 2 is a graphical illustration of an interactive graphical display implemented with a cursor system according to an exemplary embodiment of the present invention.
Figure 2B:
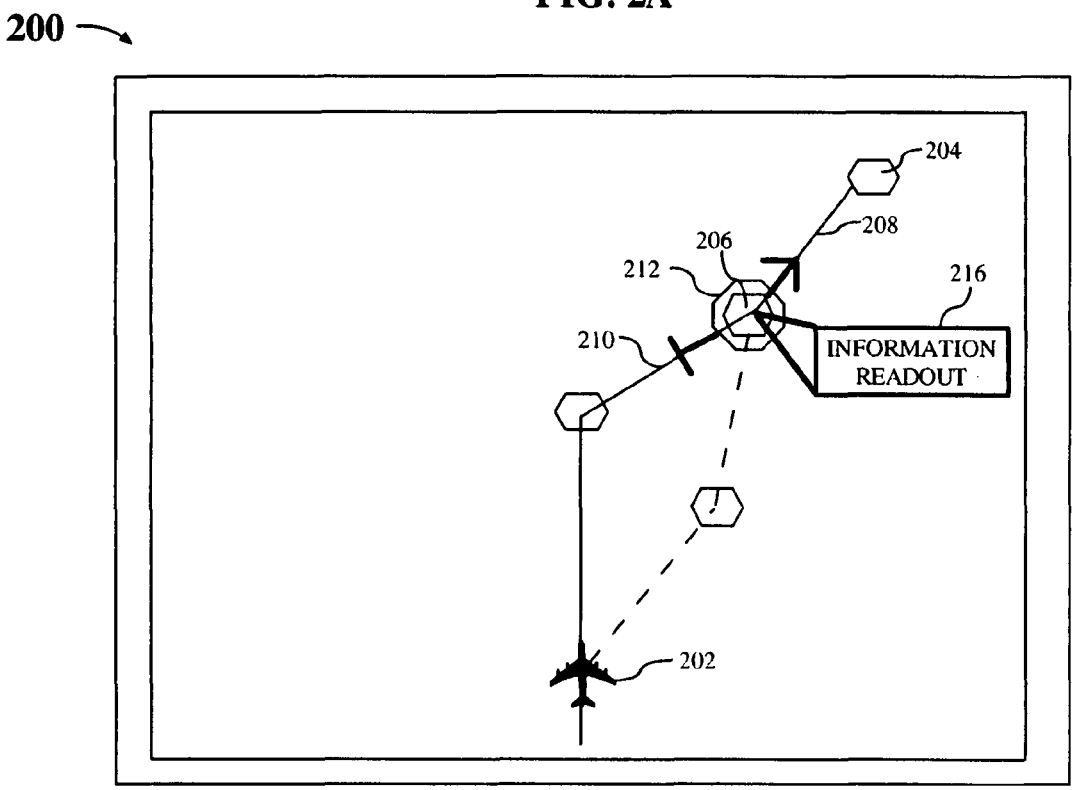

Referring now to FIGS. 2A and 2B, graphical illustration of an interactive graphical display 200 implemented with a cursor system according to an exemplary embodiment of the present invention are shown. An exemplary display 200 may provide a lateral view, a vertical profile view (or "vertical profile"), a broadened lateral view, and the like. Referring to FIG. 2A, the display is depicted the context of an active flight plan comprising a popup menu associated with a current waypoint. Lateral view, such as the views shown in FIGS. 2A and 2B suitably comprise various graphical elements, images or symbols representing positional information including the lateral position of the aircraft with respect to the ground. In the illustrated embodiment, display 200 comprises a top view aircraft symbol 202, one or more waypoint symbols 204, 206, and line segments 208, 210 connecting the waypoint symbols 204, 206. The waypoint symbols 204, 206 may be associated with the current flight-path of the aircraft. The display 200 may also comprise various map features, including terrain, political boundaries, and the like.

An operator receives visual feedback via the display 200 which is produced by a monitor such as monitor 114 of FIG. 1. Display 200 any display suitable for displaying the various symbols and information detailed below. Many currently known monitors are suitable for this task, including various CRT and flat-panel display systems. Display 200 may suitably include a graphical interface with virtual buttons, pull-down menus, and/or dialogue windows to control the map appearance, FMS and the like as appropriate. Display 200 also comprises various graphical elements associated with the lateral position, vertical position, flight-plan and/or other indicia of the aircraft's operational state as determined from avionics data and/or data sources. Through use of cursor control device 104, operator 112 may modify the flight-plan and/or other such indicia graphically in accordance with feedback provided by the display 200.

In additional embodiments, display 200 may be a vertical profile display comprising a side-view aircraft symbol, one or more waypoint symbols, constraint symbols, line segments connecting waypoint symbols, a first axis representing lateral position and/or time, a second axis, designating altitude and any other features typical of a vertical profile display. As with the lateral view display 200 described above, the vertical profile display may be configured such that an operator may modify the flight plan and trajectory via graphical manipulation of symbols utilizing the cursor image. For vertical profile display window embodiments, context sensitive operations suitable for vertical modes of flight planning may be provided.

In yet additional embodiments, display may be a broadened lateral view display. A broadened lateral view, or "hot map" view may encompass a larger and more simplified lateral area than that shown in a lateral view or a vertical profile display. For instance, a rectangular or square outline corresponding to a region shown in a lateral view may be displayed in a hot map. Furthermore, a hot map may preferably include a simplified terrain display showing, for example, land/water boundaries and the like.

Display 200 also suitably comprises a cursor image 212 positioned in accordance with input from a user input device 102 received via cursor control device 104. Cursor image 212 is suitably positioned by the user in order to select and graphically edit the flight plan associated with waypoints, or to perform other tasks as appropriate. Display 200 may provide information such as distance to next waypoint, time to next waypoint, altitude, and the like. Information may be located proximally to a selected path portion highlighted by the cursor image 212. However, if the information readout adjacent to the cursor image 212 obstructs the flight plan or other elements of the display, an alternative implementation would place the information readout at a fixed location elsewhere on the display.

Referring to FIG. 2A, display 200 may be suitable for displaying a menu 214. Menu may be generated by a menu engine such as menu engine 106 as shown in FIG. 1. System 100 may utilize a select function, such as a secondary mouse button to call up the menu 214 on the display 200. It is contemplated that menu 214 may be a context sensitive menu. A context sensitive menu may be a menu suitable for appearing on a display in response to a user action. Context sensitive menu contents may be determined by a selected application window, or a window having the input focus. The context sensitive menu may also comprise functions available in a menu bar and provide access to a subset of functions that may be relevant to the selected region.

Referring to FIG. 2B, display 200 may be suitable for displaying a digital information display 216. Digital information display 216 may be adjacent to the cursor image and may be suitable for providing information such as the distance to the next lateral waypoint in the flight plan, aircraft positional information at the selected point, and the like. In an additional embodiment, the information display 216 may appear in a location substantially away from the selected point on the display, as may be desired by a user.

In a preferred embodiment, menu 214 may provide information such as the current charts relative to the cursor image position as a context sensitive menu option when the cursor image is selected. For instance, when the cursor image is placed on a given waypoint, any chart including the waypoint may be included under a menu option. Menu option may be labeled "charts," "graphs," or any like suitable label. Charts menu option may comprise enroute charts, SID/STAR charts, approach charts and the like. The charts selection may also be included when the cursor image is placed on any flight plan objects such as flight plan segments that are part of an approach procedure.

Figure 3A:
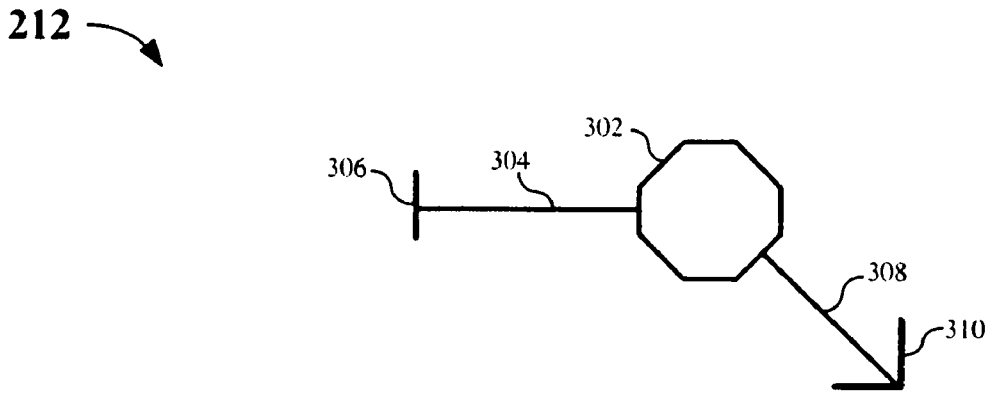
FIG. 3 is a graphical illustration of a cursor image implemented in a graphical display according to an exemplary embodiment of the present invention.
Figure 3B:
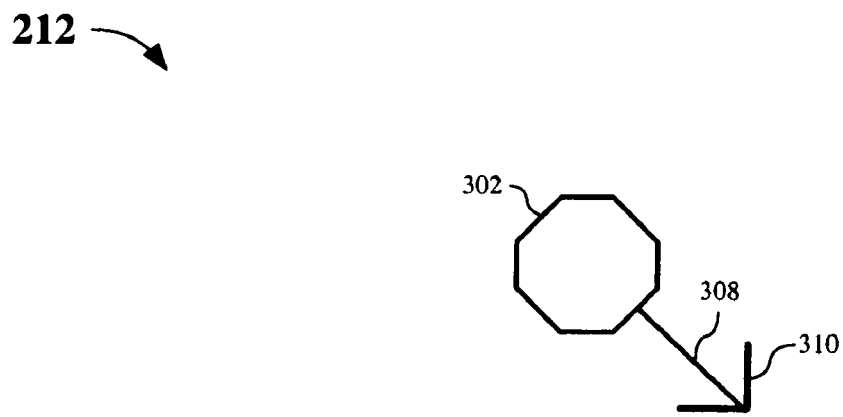
Figure 3C:
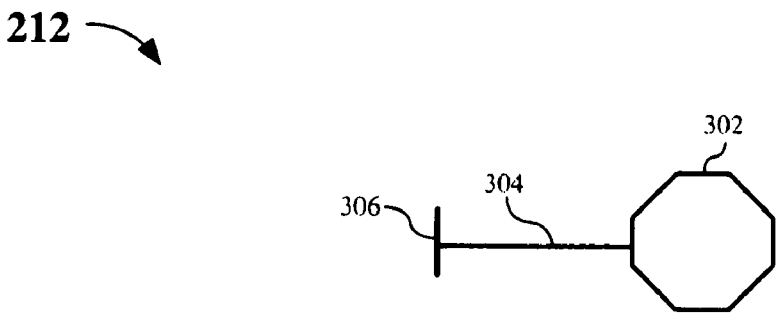

Referring to FIGS. 3A, 3B, and 3C graphical illustrations of a cursor image 212 in accordance with exemplary embodiments of the present invention are shown. Cursor image 212 may be capable of selecting and displaying points on a flight plan, and subsequently displaying any relevant flight plan options associated with that specific position on the flight plan as the cursor travels through points on the flight plan. It is further contemplated that the cursor image 212 may also be suitable for providing an anchor point cursor for selecting objects graphically via moving selection zones.

Cursor image 212 may comprise at least two components 302, 304. At least one of the two components may be visible when the cursor image 212 is activated by the cursor control device. In an exemplary embodiment, cursor image 212 may comprise a body component 302 and at least one arm component 304 extending substantially outward from the body component 302. The body component 302 may be defined as a region at least the size of the center shape of a waypoint, and may be circular or multilateral. For instance, body component 302 may be substantially octagonal, square, rectangular, triangular, or a like multilateral shape. At least one arm component 304 may appear along the flight plan with a first directional indicator 306 indicating the direction from a point on the flight plan. Cursor image 212 may further comprise a second arm component 308 extending substantially outward from the body component 302 in a direction other than the direction in which the first arm component extends. Second arm component 308 may comprise a second directional indicator 310 such as an arrow or like indicia and may provide an indication of the direction of forward progress of an aircraft. Arm components 304, 308 may be extendable to any desired length and may track along the flight plan. Either one of the first and second directional indicators 306, 310 may not be visible if the cursor image is at either the origin or a final destination.

The first and second arm components 304, 308 may snap to following the flight plan segments when the cursor image 212 is placed on a waypoint. An arm component 304, 308 may extend beyond the waypoint, however, the arm component 304, 308 may remain oriented to the current track until the cursor body component 302 contacts the waypoint. Therefore, an arm component 304, 308 may extend beyond the waypoint into space. Extension of an arm component 304, 308 beyond the waypoint may provide an operator an accurate distance measurement when close to a waypoint while providing a visual cue that the distance displayed is not to the next waypoint in the flight plan. To this end, first and second arm components 304, 308 of a cursor image 212 may appear as bolder or brighter than the flight plan route line displayed, or may be a displayed in a different color than the route line, or visibly thicker than the route line.

Systems and apparatuses in accordance with various aspects of the present invention provide an improved graphical user interface for entry and editing of information in an aircraft environment, such as aircraft flight-plan data, flight control parameters, aircraft systems control or the like. In this regard, the present invention may be described herein in terms of functional block components and various processing steps. It should be appreciated that such functional blocks may be realized by any number of hardware, firmware, and/or software components configured to perform the specified functions. For example, the present invention may employ various integrated circuit components, e.g., memory elements, digital signal processing elements, look-up tables, and the like, which may carry out a variety of functions under the control of one or more microprocessors or other control devices. Such general techniques and components that are known to those skilled in the art are not described in detail herein. Furthermore, although the invention is frequently described herein as pertaining to interfaces used in a cockpit environment, it will be appreciated that the systems and methods described herein could also be applied to graphical flight planning software, flight simulators, or any other program having a user interface.

Various embodiments of the present invention include one or more techniques described below relating to improved cursor control. Each of these techniques may be implemented using standard user interface techniques, such as standard graphical software programming or the like. Of course any programming language or environment could be used to implement the techniques described herein.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is utilized to program a computer to perform the disclosed function and process of the present invention. The computer-readable medium may include, but is not limited to, any type of conventional floppy disk, optical disk, CD-ROM, magneto-optical disk, ROM, RAM, EPROM, EEPROM, magnetic or optical card, or any other suitable media for storing electronic instructions.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

The invention claimed is:

1. A system for providing a manipulatable graphical display comprising:

a user input device responsive to a user input;

a cursor control device operably coupled to said user input device;

a menu engine operably coupled to said cursor control device;

a processor configured to communicate with a monitor and avionics data received from one or more data sources; and control programming for processing an output received from said user input device and generating a cursor image positioned on a display in response to said output, said cursor image suitable for locking onto and tracing a path on said display, said path includes at least one predetermined flight plan routing segment, said cursor image includes a body component and an arm component connected to the body component, the body component including at least one of a circle or multi-lateral shape, the arm component being connected to the body component and overlays at least a portion of said at least one predetermined flight routing segment.

2. The system of claim 1, said cursor control device is at least one of a button, joystick, mouse, trackball, turn knob, keyboard or a touch-pad interface device.

3. The system of claim 1, wherein said cursor control device is suitable for positioning said cursor image to select and graphically edit said predetermined flight plan routing segment.

4. The system of claim 1, wherein said menu engine is suitable for generating an information readout suitable for providing flight information and an interactive menu suitable for providing flight information and flight path manipulation.

5. The system of claim 1, wherein the control programming provides a release function suitable for removing said cursor image from said path.

6. The system of claim 1, wherein movement of said cursor image is constrained to said path subsequent to locking onto said path on said display.

7. A method for providing a manipulatable graphical display comprising:

receiving a first input from an operator;

transmitting a first output to a cursor control device based on the first input;

providing movement instructions to a cursor image of the graphical display based on the first output;

locking the cursor image onto a flight plan route of the graphical display, said cursor image includes a body component and an arm component connected to the body component, the body component including at least one of a circle or multi-lateral shape, the arm component being connected to the body component and overlays at least a portion of said flight plan route; and constraining movement of the cursor image exclusively along the flight plan route subsequent to locking the cursor image onto the flight plan route.

8. The method of claim 7, wherein the manipulatable graphical display includes one of a lateral view, a vertical profile view, or a broadened lateral view.

9. The method of claim 7, further comprising:

providing a release function for removing the cursor image from the flight plan route.

10. The method of claim 7, wherein the at least one arm component is at least one of brighter than the flight plan route, a different color than the flight plan route, visibly thicker than the flight plan route, or bolder than the flight plan route.

11. A computer program product for providing a manipulatable graphical display, comprising:

a computer-readable non-transitory storage medium bearing program instructions, the program instructions operable to perform a process in a computer system, the process including:

receiving a first input from an operator;

transmitting a first output to a cursor control device based on the first input;

providing movement instructions to a cursor image of the graphical display based on the first output;

locking the cursor image onto a flight plan route of the graphical display, said cursor image includes a body component and an arm component connected to the body component, the body component including at least one of a circle or multi-lateral shape, the arm component being connected to the body component and overlays at least a portion of said flight plan route; and constraining movement of the cursor image exclusively along the flight plan route subsequent to locking the cursor image onto the flight plan route.

12. The process of claim 11, further comprising:

providing a release function for removing the cursor image from the flight plan route.

13. The process of claim 11, further comprising:

displaying an interactive menu for flight path manipulation and displaying flight information.

14. The process of claim 11, wherein the at least one arm component is at least one of brighter than the flight plan route, a different color than the flight plan route, visibly thicker than the flight plan route, or bolder than the flight plan route.

* * * * *